US005785609A

United States Patent [19]

Sheets et al.

[11] Patent Number: 5,785,609

[45] Date of Patent: Jul. 28, 1998

[54] GOLF CLUB HEAD

[75] Inventors: Jeffrey D. Sheets, Wilbraham; Tom Greene, Monson, both of Mass.; Lee Trevino, Dallas, Tex.

[73] Assignee: Lisco, Inc., Tampa, Fla.

[21] Appl. No.: 868,836

[22] Filed: Jun. 9, 1997

[51] Int. Cl.[6] ..... A63B 53/04

[52] U.S. Cl. ..... 473/327; 473/328; 473/345

[58] Field of Search ..... 473/324, 328, 473/344, 345, 346, 349, 350

[56] References Cited

U.S. PATENT DOCUMENTS

| | | | |
|---|---|---|---|
| D. 275,412 | 9/1984 | Simmons . | |
| D. 310,254 | 8/1990 | Take et al. . | |
| D. 371,817 | 7/1996 | Olsavsky et al. . | |
| D. 374,899 | 10/1996 | Mahaffey . | |
| 1,541,126 | 6/1925 | Dunn . | |
| 1,868,286 | 7/1932 | Grieve . | |
| 1,916,792 | 7/1933 | Hadden . | |
| 3,068,011 | 12/1962 | Sano | 473/328 |
| 3,079,157 | 2/1963 | Turner . | |
| 3,166,320 | 1/1965 | Onions . | |
| 3,810,631 | 5/1974 | Braly . | |
| 4,322,083 | 3/1982 | Imai . | |
| 5,060,949 | 10/1991 | Brill . | |
| 5,203,565 | 4/1993 | Murray et al. . | |
| 5,257,786 | 11/1993 | Gorman | 473/328 |
| 5,301,945 | 4/1994 | Schmidt et al. | 473/328 |
| 5,380,009 | 1/1995 | Henry et al. . | |
| 5,456,469 | 10/1995 | MacDougall | 473/328 |
| 5,465,970 | 11/1995 | Adams et al. . | |
| 5,484,155 | 1/1996 | Yamawaki et al. . | |
| 5,497,995 | 3/1996 | Swisshelm . | |
| 5,547,188 | 8/1996 | Dumontier et al. . | |
| 5,573,469 | 11/1996 | Dekura . | |

FOREIGN PATENT DOCUMENTS

| | | |
|---|---|---|
| 364845 | 1/1932 | United Kingdom . |

OTHER PUBLICATIONS

Console Advertisement, Golf World, Feb. 13, 1976, p. 9.

Crown Golf Advertisement, Golf World, Aug. 19, 1997, p. 37.

*Primary Examiner*—Sebastiano Passaniti

*Attorney, Agent, or Firm*—Donald R. Bahr; Laubscher & Laubscher

[57] ABSTRACT

A metalwood golf club head including upper and lower surfaces, a front ball striking face and a curved rear surface is characterized by a concave projection in the lower surface extending from the face toward the rear surface. The depth of the concavity in the projection is governed by the loft of the club face, with the depth being greater for higher lofted clubs. The concave projection enables the club head to strike to golf ball resting on the ground, and particularly in a poor lie such as in a bunker or deep rough, without the head becoming buried in the ground.

7 Claims, 1 Drawing Sheet

GOLF CLUB HEAD

BACKGROUND OF THE INVENTION

In the game of golf, various club types are used to play different golf shots. These club types include woods, irons, and a putter. Increasingly, woods are being used to play golf shots where the ball is resting on the ground rather than on a tee. Because a wood has an enlarged rearwardly rounded head as compared to an iron, conventional woods are not suitable for use in playing a shot from thick rough or from a bunker since the woods have a tendency to hang up or become buried in such environments. The present invention relates to an improved golf club wood head designed for shot making from difficult lies in thick rough and fairway bunkers. The head has a unique sole design to provide the wood with sufficient bounce similar to that of a sand wedge to prevent the head from becoming buried while striking a golf ball.

BRIEF DESCRIPTION OF THE PRIOR ART

Numerous golf club heads, and particularly wood heads, have been developed for use in striking a golf ball off the ground rather than from a tee. One such head is a brassie or fairway wood. The Dunn U.S. Pat. No. 1,541,126 for example, discloses a brassie having a concave sole extending from the head to the toe of the club head. The concave sole effectively raises the center of gravity of the head so that is aligned with the center of gravity of the golf ball being struck.

A more recent development is the BUSHWACKER lofted wood manufactured by Crown Golf, Inc. In the 1970's which has a heavy brass sole plate including a downward bulge to assist in lifting the ball from difficult lies.

Also known in the art are golf club woods heads having a median rib in relief with respect to the sole of the club and perpendicular to the club face as shown in the Dumontier et al U.S. Pat. No. 5,547,188.

While the prior devices operate satisfactorily, there still exists the need for a wood type club head which has versatility for playing long shots from difficult lies such as in heavy rough and fairway bunkers as well as from easier fairway lies. The present invention relates to such a club head.

SUMMARY OF THE INVENTION

Accordingly, it is a primary object of the invention to provide a golf club head including a metal body having an upper surface, a lower surface, a front ball striking face, and a curved rear surface. The lower surface includes a concave projection extending between the face and the rear surface. The concave front-to-back projection in the lower surface prevents the club head from becoming buried in the ground while striking a golf ball.

According to a more specific object of the invention, the club head lower surface contains a pair of stepped lower recesses on opposite sides of the projection. The recesses extend from the rear surface to a location short of the face.

According to a further object of the invention, the depth of the concavity within the projection increases as the loft of the striking face increase.

BRIEF DESCRIPTION OF THE FIGURES

Other objects and advantages of the invention will become apparent from a study of the following specification, in which.

DETAILED DESCRIPTION

Figure 1:
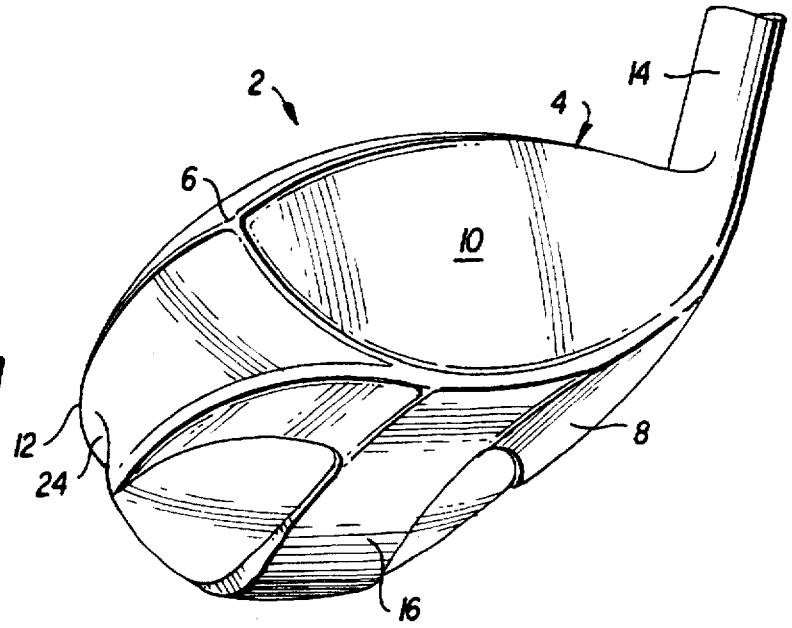
FIG. 1 is a perspective view of the golf club head according to the invention.

As shown in the drawing, the present invention relates to a golf club head 2 and more particularly to a wood style golf club head including a metal body 4 having an upper surface 6, a lower surface 8, a front ball striking face 10, and a curved rear surface 12. At the heel end of the body is a hosel 14 for connection with a shaft to form the complete golf club.

Figure 2:
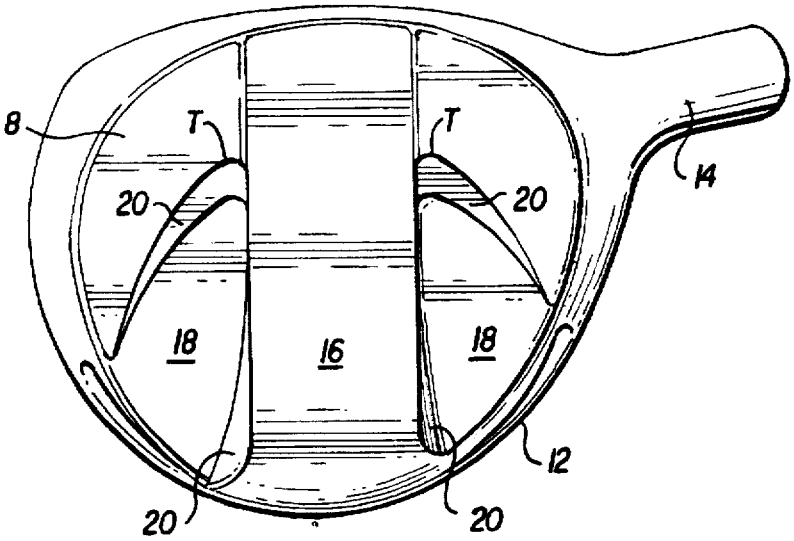
FIG. 2 is a bottom plan view of the club head of FIG. 1.

As shown in FIGS. 1 and 2, the lower surface 8 of the head body has a unique T-shaped configuration defined by a lateral projection 16 extending between the face and the rear surface and by a pair of recesses 18 on opposite sides of the projection. The projection preferably extends along the lateral median of the head as best shown in FIG. 2. Moreover, the recesses on each side of the projection preferably include a step 20 and extend from the rear surface of the head to a terminating location T short of the face.

Figure 3:
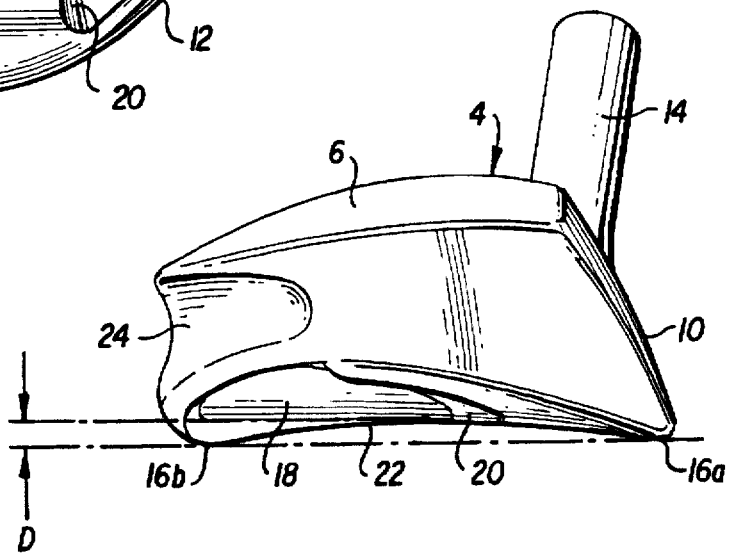
FIG. 3 is an end plan view of the club head of FIG. 1.

Referring now to FIG. 3, the projection has a concave configuration, with the concavity 22 extending along the length of the projection. Preferably, the projection has a forward portion **16*a* adjacent to the lower end of the face 10 which is parallel to the ground. This forward portion of the club sole prevents the club from digging into the ground while a golf swing is executed to strike a golf ball resting on the ground. The projection also has a rearward portion 16*b*, at the opposite end of the concavity 22 from the forward portion 16*a***, which is generally co-planar with the forward portion. The rearward portion of the projection provides a certain degree of bounce to the club head as the head passes along the ground while striking the ball to further prevent the club head from digging into or becoming buried in the ground, a bunker, a thick rough. In this regard, the concave projection on the lower surface of the club provides a feel and performance similar to a sand wedge when playing the ball from a difficult lie.

The face 10 of the club head can be provided with a desired degree of loft, and different heads incorporating different lofts are possible according to the invention. Generally, the greater the degree loft of the striking face (i.e. the angle between a line perpendicular to the ground at the lower edge thereof), the greater the depth D of the concavity. Thus, a three-wood having a loft of 16° has a shallower concavity 22 within the projection than a nine-wood having a loft of 29°.

The rear surface 12 of the club head 4 contains a generally horizontal lateral depression 24. The depression improves the aerodynamics of the head and also reduces the weight thereof.

As noted above, the head is preferably formed of metal. It can be cast as a unitary body or may have separate components securely connected together. For example, the striking face 10 may be inserted into a recess provided in the front of the head, allowing the face to be formed of a material different from that of the head body.

While in accordance with the provisions of the patent statute the preferred forms and embodiments of the invention have been illustrated and described, it will be apparent to those of ordinary shill in the art that various changes and modifications may be made without deviating from the inventive concepts set forth above.

What is claimed is:

1. A golf club head, comprising a metal body including an upper surface, a lower surface, a front ball striking face, and a curved rear surface, said lower surface including a lateral projection extending downwardly therefrom between said face and said rear surface, said projection having a concave configuration, whereby said club head is prevented from becoming buried in the ground when striking a golf ball.

2. A golf club head as defined in claim 1, wherein said lower surface contains a pair of recesses on opposite sides of said projection, respectively, said recesses extending from said rear surface and terminating at a location short of said face.

3. A golf club head as defined in claim 2, and further comprising an intermediate portion between said lower surface and each of said recesses, thereby to define a stepped configuration within said lower surface.

4. A golf club head as defined in claim 1, wherein said rear surface contains a generally horizontal depression extending laterally between toe and heel portions of the head.

5. A gold club head as defined in claim 1, wherein the depth of the concavity within the projection increases relative to said projection as the loft of said striking face increases.

6. A golf club head as defined in claim 1, wherein said projection has a forward portion parallel to the ground when said club head is positioned to address a golf ball resting on the ground.

7. A golf club head as defined in claim 1, wherein said projection extends along a middle portion of said lower surface.

* * * * *